United States Patent [19]

Fivecoate

[11] Patent Number: 4,985,974

[45] Date of Patent: Jan. 22, 1991

[54] HAND-HELD DEVICE FOR REMOVING A PAINT ROLLER PAD FROM A PAINT ROLLER SUPPORTING FRAME

[76] Inventor: Mark Fivecoate, 670 E. 48th, Brooklyn, N.Y. 11203

[21] Appl. No.: 503,890

[22] Filed: Apr. 7, 1990

[51] Int. Cl.[5] ..... B25B 27/00

[52] U.S. Cl. ..... 29/268

[58] Field of Search ..... 222/325–327, 222/391; 81/129, 367–381, 383, 152, 418, 424.5, 419, 426, 426.5; 269/6, 212–215, 216, 228; 254/108–111; 29/268, 252, 251, 246, 261–262

[56] References Cited

U.S. PATENT DOCUMENTS

| | | | |
|---|---|---|---|
| 1,622,218 | 3/1927 | Barnett | 29/268 |
| 3,144,707 | 8/1964 | Hiestand | 29/268 |
| 3,314,320 | 4/1967 | Early | 29/268 |
| 4,253,648 | 3/1981 | Meeks | 269/6 |
| 4,617,710 | 10/1986 | Kotnik | 29/268 |
| 4,878,155 | 10/1989 | Goul | 269/6 |
| 4,893,801 | 1/1990 | Flinn | 269/6 |

*Primary Examiner*—Robert C. Watson

*Attorney, Agent, or Firm*—Terry M. Gernstein

[57] ABSTRACT

A device grasps a paint roller pad and includes a piston which engages a frame and moves that frame with respect to the pad when a trigger is operated. The pad is thus moved off of the frame without requiring the user to touch the pad which may be covered with paint. Various size piston mechanisms can be used to accommodate various size paint roller pads.

3 Claims, 3 Drawing Sheets

HAND-HELD DEVICE FOR REMOVING A PAINT ROLLER PAD FROM A PAINT ROLLER SUPPORTING FRAME

TECHNICAL FIELD OF THE INVENTION

The present invention relates to the general art of hand tools, and to the particular field of painting equipment.

BACKGROUND OF THE INVENTION

A paint roller device is an efficient means for applying paint to a surface. A paint roller device generally includes a frame having a handle at one end and a roller-frame cage on the other end. A roller cover or roller pad is releasably mounted on the cage, and paint is stored in a roller pan. The pad is dipped and rolled in the roller pan and paint is held on that pad. The pad is then rolled over a surface to transfer paint to that surface.

While quite efficient, these paint roller devices have several drawbacks which inhibit the full commercial acceptance thereof. One such drawback is associated with removing the pad from the cage after use. The roller pad is often covered with paint and may be stuck in place on the cage. A paint-covered roller pad may be quite messy and onerous to remove from a roller cage. Because of this, many such devices are not used, or are discarded after use.

Therefore, there is a need for a device which can quickly and easily remove a roller pad from a roller frame and can do so without requiring a user to touch the pad.

OBJECTS OF THE INVENTION

It is a main object of the present invention is to provide a device which can quickly and easily remove a roller pad from a roller frame.

It is another object of the present invention to provide a device which can quickly and easily remove a roller pad from a roller frame without requiring a user to touch the pad.

SUMMARY OF THE INVENTION

These, and other, objects are achieved by a hand-held device which can grip a roller pad and remove that pad from a paint roller frame. The device includes a collar-actuated roller gripping mechanism and a trigger-actuated piston which grip the paint roller pad and separate it from the roller frame respectively.

The user need not touch the pad in order to grip it, nor is the user required to touch either the frame or the pad in order to remove the pad from the roller frame.

BRIEF DESCRIPTION OF THE DRAWING FIGURES

DETAILED DESCRIPTION OF THE PREFERRED EMBODIMENT OF THE INVENTION

Figure 1:
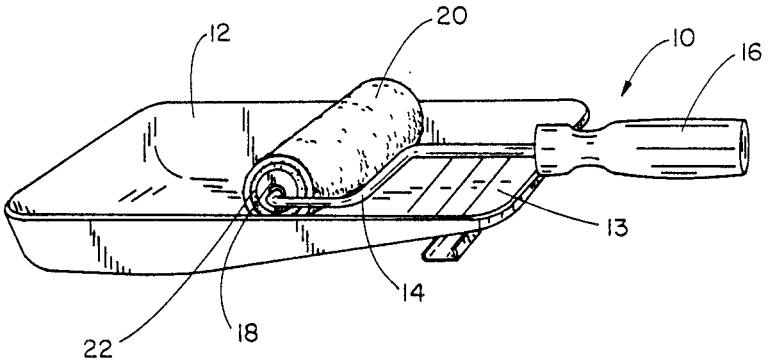
FIG. 1 is a perspective view of a paint roller in a roller pan.

Shown in FIG. 1 is a paint roller device 10 in place in a roller pan 12 having a tray grid 13. The paint roller includes a roller frame 14 having a handle 16 on one end thereof and a roller-frame cage 18 on the other end. A roller pad 20 having a core 22 is mounted on the cage. Paint is placed in the tray and the roller pad is dipped and rolled in that paint. The roller pad is then rolled over a surface to transfer paint from that pad to the surface.

After use, it is generally advised that the roller pad be cleaned. The most efficient manner of cleaning such pads is to remove the pad from the cage, and wash the pad under water or other solution.

However, it has been found that it is often difficult and messy to remove the pad from the cage, especially if the pad has become stuck onto that cage and is full of paint. The present invention provides a device for separating the roller pad from the cage without requiring the user to come into contact with either the cage or the pad.

Figure 2:
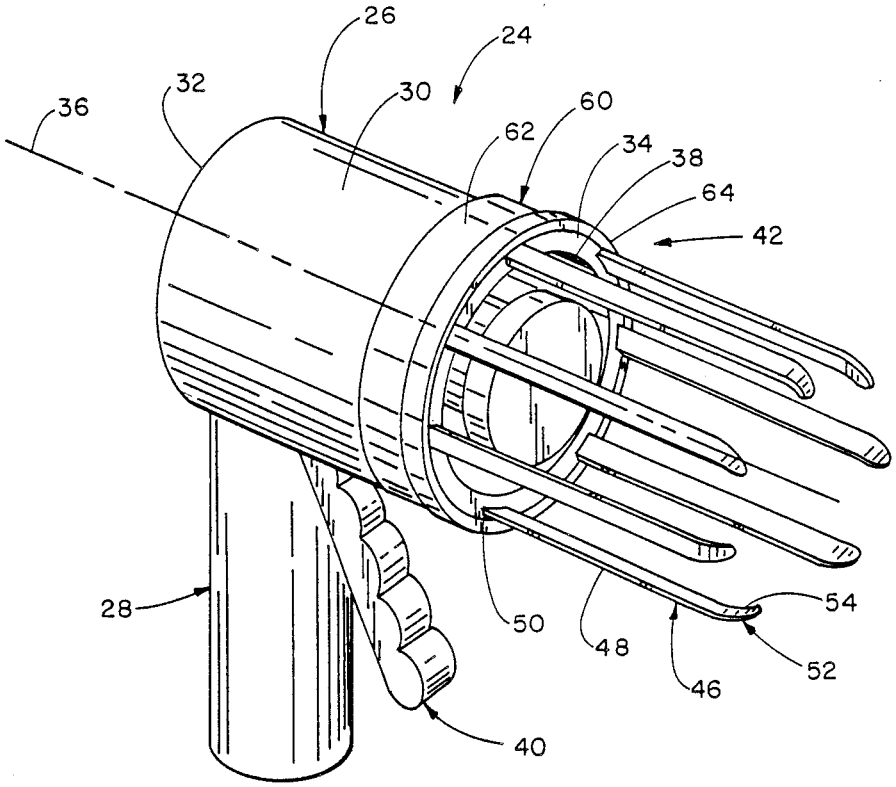
FIG. 2 is a perspective view of a hand-held device for removing a roller pad from a roller frame as embodied in the present invention.

The invention is embodied in a hand-held device 24, best shown in FIG. 2 as including a housing 26 with a handle section 28 that is grasped by the user and a head section 30 mounted on top of that handle section. The head section 30 includes an aft end 32 located near the handle section and a forward end 34 with a longitudinal axis 36 extending between the forward and aft ends. The head section is hollow and has a bore 38 defined axially therethrough.

A trigger lever 40 is pivotably attached to the housing and extends into the bore 38 through an elongated slot defined in the head section. The trigger lever is operated by the user as he holds the handle section. The trigger lever will be discussed in greater detail below.

The device further includes a paint roller pad gripping assembly 42 mounted on the housing head section near the front end 34 thereof. The gripping assembly includes a multiplicity of pad gripping prongs, such as prong 46, that are in angularly spaced apart locations about the housing front end. The prong 46 includes a body 48 which is flexible, and which has a proximal end 50 thereof fixed to the housing top section front end and which extends outwardly of that housing front end along the longitudinal axis 36. The prong 46 has a distal end 52 that is spaced from the housing end 34 and which includes a pad engaging portion 54. The pad engaging portion is bent inwardly of the body toward the longitudinal axis 36 to form a claw that engages into the pad 20 to grip that pad. The prongs are formed of metal or the like to be flexible, and are mounted in a circular arrangement around the longitudinal axis, and are adapted to be moved toward that longitudinal axis into a pad engaging position to have the claws engage the roller pad, and to move into the pad releasing position with the claws situated to permit the pad to be moved with respect to the claws. The pad releasing position is shown in FIG. 2.

The prongs are moved from the FIG. 2 pad releasing position to the pad engaging position by a collar 60 that encircles the prongs and the housing near the end 34. The collar includes a body 62 and a shoulder 64 and is moved by hand from the releasing position shown in FIG. 2 and in full lines in FIG. 5, to a prong engaging position near the distal ends of the prongs and shown in phantom lines in FIG. 5. When the collar is moved toward the phantom line position shown in FIG. 5, the collar forces the claws into the roller pad thereby gripping that pad.

Figure 3:
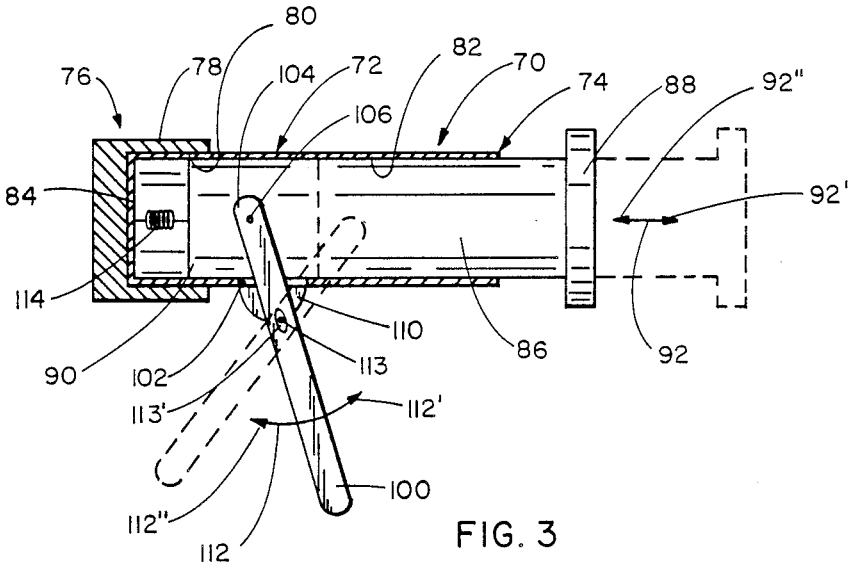
FIG. 3 is a schematic illustrating a trigger-actuated piston mechanism used to separate a paint roller pad from a paint roller cage.

The roller pad is pushed off of the frame by moving that frame with respect to the gripped pad. The pad is moved by a piston mechanism 70 best shown in FIG. 3.

The piston mechanism 70 is mounted in the housing head section to extend along the longitudinal axis 36 and includes a housing 72 having a forward end 74 and a rear end 76. The housing 72 is slidably mounted in the head section 30 to be removably accommodated therein. The removable nature of the piston mechanism permits that mechanism to be cleaned, and changed to fit different size paint roller pads.

The housing 72 has a rear bearing element 78 mounted on the rear of the housing 72. The bearing element has an outer diameter that matches the inner diameter of the head section bore 38 to abut the head section adjacent to that bore, and a blind-ended bore 80 which is sized to snugly receive the housing 72. Thus, different size housings 72 can be accommodated in the same size bore 38 by varying the size of the bearing bore 80 while keeping the outer diameter of that bearing constant and equal to the inner diameter of the bore 38.

Figure 4:
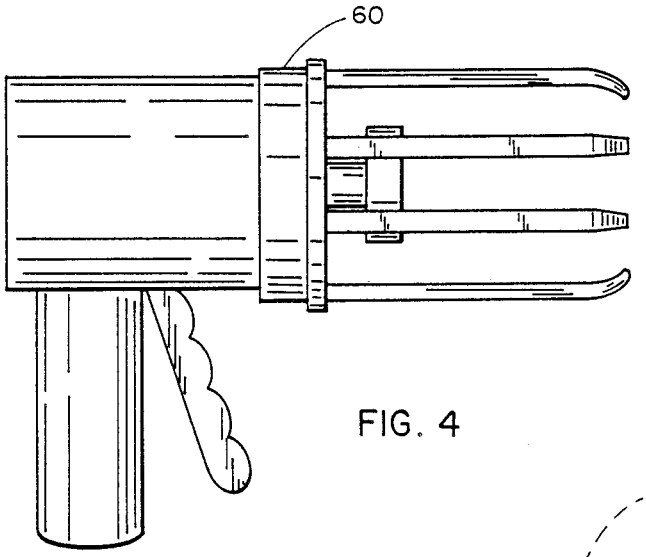
FIG. 4 is an elevational view thereof.
Figure 5:
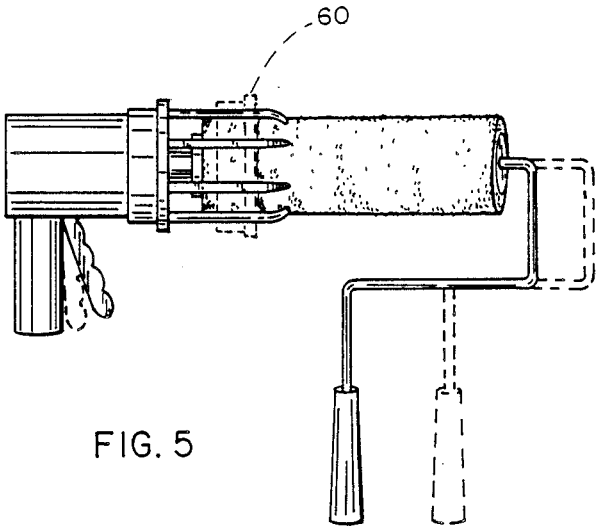
FIG. 5 is an elevational view of the device of the present invention in engagement with a roller pad on a roller cage.

The housing 70 has a bore 82 defined longitudinally thereof to extend from the forward end 74 to a rear end 84. A piston 86 is slidably mounted in the housing 70 and includes a forward roller pad abutting end 88 and a rear end 90. The piston moves in the bore 82 in the directions indicated by 92' and 92" by the double-headed arrow 92. The piston moves in direction 92" from a cocked position shown in full lines in FIG. 3 with the rear end 90 closely adjacent to the housing rear end 84 to a releasing position shown in phantom lines in FIG. 3 and in full lines in FIG. 4 with the rear end 90 located farther away from the end 84. When the piston is in the releasing position, the front end of that piston engages the roller frame and pushes that frame with respect to the roller pad that is clamped in place by the claws 54 of the prongs 50. This forces the frame away from the roller pad, thereby separating the roller pad from the frame. Movement of the frame with respect to the clamped roller pad is indicated in FIG. 5 as being from the full line position to the released position shown in phantom lines.

The piston is moved by the trigger mechanism 40 which includes a trigger lever 100 that extends through slot 102 defined in the housing 72 and through a slot defined through the head section. The lever 100 includes a top end 104 connected to the piston by a connecting pin 106 and a bottom end 108. The lever is connected to the housing head section by a fulcrum 110 mounted on the housing adjacent to the slots, and moves in directions 112' and 112" indicated by the double-headed arrow 112. When the lever is moved in direction 112', the piston is moved in direction 92' to move toward the roller releasing position. The lever is connected to the fulcrum by a pin 113 and has a coupling hole 113' defined therein. The lever can be removed from the pin by maneuvering that lever with respect to the pin 113. The lever includes an opening 106' that receives the pin 106 so that the lever can be removed from the piston by maneuvering that lever with respect to the piston. In this manner, the piston can be separated from the lever so that the piston and housing 72 can be removed from the housing head section 30. Once the lever is disconnected from the piston, the piston is simply pulled out of the housing head section. As will be discussed below, the piston is connected to the bearing 78 and this bearing will be pulled out with the piston. A new piston mechanism can be placed back into the housing head section and the trigger lever maneuvered into connection with the pins 106 and 113. The new piston mechanism can be either the same size as the removed mechanism or a different size. The holes 106' and 113' have a large section and a small section, with the large section being large enough so that the pins 106 or 113 respectively will pass through the hole and out of engagement with the lever; whereas, the small sections of the holes 106' and 113' are smaller than the pins so those pins engage the lever adjacent to the hole.

The piston mechanism includes an extension spring 114 having one end thereof connected to the wall 84 and another end thereof connected to the piston rear end 90. The spring 114 resists movement of the piston in the direction 92', and tends to pull the piston back into the cocked position in direction 92".

Figure 6:
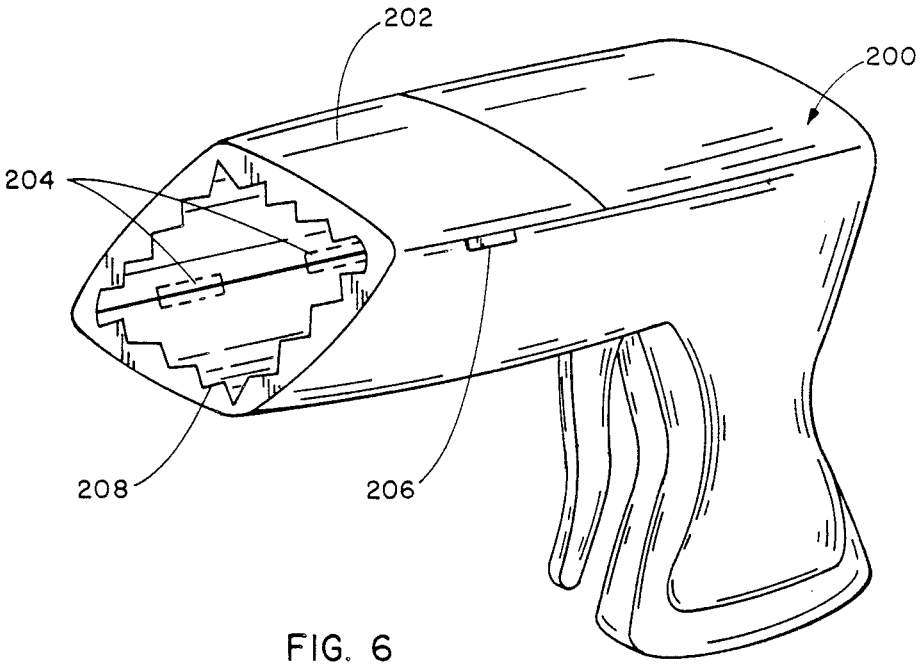
FIG. 6 is a perspective view of an alternative embodiment.
Figure 7:
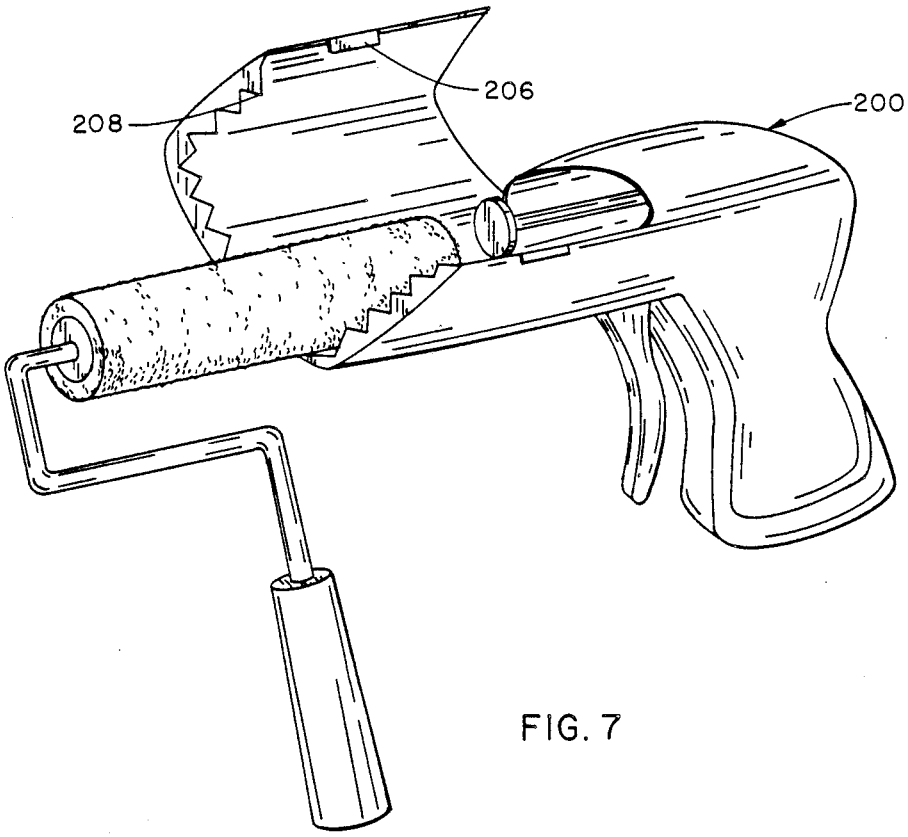
FIG. 7 is a perspective view of the alternative embodiment in conjunction with a roller unit.

An alternative embodiment of the device is shown in FIGS. 6 and 7. The alternative form of the device includes a housing 200 having a forward portion 202 which moves from the FIG. 6 position closing the housing to the FIG. 7 position opening the housing. The forward portion 202 is attached to the remainder of the housing by hinges 204 mechanism and a latch 206.

The forwardmost end of the housing and the forward portion includes a plurality of gripping teeth 208. As shown in FIG. 7, these teeth engage the roller to grasp it while the piston mechanism forces the roller pad and the roller frame. The piston mechanism operates in the manner discussed above.

It is understood that while certain forms of the present invention have been illustrated and described herein, it is not to be limited to the specific forms or arrangements of parts described and shown.

I claim:

1. A hand-held device for removing a paint roller pad from a paint-roller supporting frame comprising:

(A) a housing which includes (1) a handle section, (2) a head section having an aft end located near said housing handle, a forward end, and a longitudinal axis extending between said aft end and said forward end, said head section having a trigger slot defined therein near said handle section and having a bore defined therein, (3) a trigger lever extending through said trigger slot and having a top end located inside said housing head section, and a bottom end, (4) a fulcrum mounting attached to said trigger lever between said trigger lever ends and pivotably mounting said trigger lever to said housing, and (5) said trigger lever moving between a first position with said bottom end spaced from said handle section and a second position with said bottom end located closer to said housing handle section than said first position;

(B) a paint roller pad gripping assembly mounted on said housing and including (1) a multiplicity of prongs, each prong of said multiplicity of prongs including (a) a body, (b) a proximal end mounted on said housing head section adjacent to said head section forward end, (c) a distal end spaced from said head section forward end, and (d) a paint roller pad engaging claw on said distal end, said claw extending at an angle with respect to said body towards said head section longitudinal axis, (2) a collar encircling all of said prongs and being slidable along said prongs in a direction of said head section longitudinal axis from a releasing position adjacent to said head section forward end to a gripping position adjacent to said prong distal ends; and (C) a piston mechanism slidably mounted in said head section bore and including (1) a case having a bore defined therein, (2) a collar mounted on one end of said case and having a blind-ended bore defined therein, said blind-ended bore snugly receiving said case, and said piston mechanism collar having an outer surface that snugly and slidably engages the inner surface of said housing head section adjacent to said housing head section bore, (3) a piston element slidably mounted in said piston mechanism bore, said piston element having a rear and a front end, (4) said piston element being slidably mounted in said piston mechanism bore to move along the longitudinal axis of said housing head section between a cocked position with said piston rear end located closely adjacent to said housing aft end and a releasing position with said piston rear end located closer to said housing section forward end, (5) a connecting means connecting trigger lever top end to said piston, and (6) an extension spring having one end thereof connected to said housing and another end connected to said piston rear end, said extension spring resisting movement of said piston from said cocked position toward said releasing position.

2. The hand-held device defined in claim 1 wherein said housing further includes a forwardmost portion, a hinge connecting said forwardmost portion to the remainder of said housing, and a latch for releasably attaching said forwardmost portion to the remainder of the housing.

3. The hand-held device defined in claim 2 further including a plurality of roller pad engaging claws on said housing housing and said forwardmost portion.

* * * * *